United States Patent [19]

Duke

[11] Patent Number: 4,823,537

[45] Date of Patent: Apr. 25, 1989

[54] METHOD OF FORMING A PILFERPROOF CLOSURE

[75] Inventor: James D. Duke, New Paris, Ohio

[73] Assignee: Aluminum Company of America, Pittsburgh, Pa.

[21] Appl. No.: 52,982

[22] Filed: May 22, 1987

[51] Int. Cl.[4] ..... B65B 7/20

[52] U.S. Cl. ..... 53/488; 413/8; 413/10; 215/252

[58] Field of Search ..... 215/252; 220/276; 413/8, 10, 12, 15, 17; 53/331, 488

[56] References Cited

U.S. PATENT DOCUMENTS

| | | | |
|---|---|---|---|
| 3,217,397 | 11/1965 | Voss | 413/8 |
| 3,273,525 | 9/1966 | Robinson | 413/10 |
| 3,303,955 | 2/1967 | Osborne et al. | 215/252 |
| 3,460,703 | 8/1969 | Leftault | 215/40 |
| 3,767,077 | 10/1973 | Rhoades | 215/42 |
| 4,055,134 | 10/1977 | Ostrem et al. | 220/276 |
| 4,105,133 | 8/1978 | La Barge et al. | 220/266 |
| 4,206,851 | 6/1980 | Ostrowsky | 215/246 |
| 4,256,234 | 3/1981 | Mori et al. | 215/343 |
| 4,418,828 | 12/1983 | Wilde et al. | 215/252 |

FOREIGN PATENT DOCUMENTS

| | | | |
|---|---|---|---|
| 1250611 | 12/1960 | France | 215/252 |
| 173682 | 12/1934 | Switzerland . | |

*Primary Examiner*—Frederick R. Schmidt
*Assistant Examiner*—Robert Showalter
*Attorney, Agent, or Firm*—David W. Brownlee; Thomas J. Connelly

[57] ABSTRACT

A method of forming either a metal or plastic pilferproof closure is disclosed. The closure has an end wall and an annular sidewall depending therefrom. For a metal closure, an annular ring is rolled in the sidewall so that it protrudes outwardly therefrom. The sidewall is scored adjacent to the annular ring to form a plurality of fracturable bridges which divide the sidewall into upper and lower portions. The annular ring is then compressed so as to form an annular bead which at least partially covers the bridges. The upper portion is susceptible to being deformed about the threaded neck of a container while the lower portion is adapted to be at least partially turned inward and into engagement with an annular shoulder formed on the container below its threaded neck. The annular bead serves to protect the fingers of a person who is removing the closure from coming in contact with the sharp edges of the broken bridges. For a plastic closure, the annular bead can be molded about a lower portion of the sidewall or it can be a separate member which is attached to the closure in a separate operation.

14 Claims, 3 Drawing Sheets

METHOD OF FORMING A PILFERPROOF CLOSURE

FIELD OF THE INVENTION

This invention relates to a method of producing a pilferproof closure and more particularly to a closure having an annular bead which shields the fingertips of a person removing the closure from the sharp edges of the broken bridges.

BACKGROUND OF THE INVENTION

Currently, pilferproof closures are used on a number of containers such as soft drink containers, pharmaceutical products, oil containers, etc. and have been readily accepted by the consumer for they provide visual indication of whether the product contained in the container has been tampered with. The pilferproof closure relies on a plurality of spaced apart fracturable bridges which connect the upper portion of the closure with a pilferproof band which normally stays with the container after the closure has been unthreaded. The pilferproof closure functions by having the fractured bridges break during the removal process such that the upper portion of the closure is separated from the pilferproof band. This action produces visible evidence that the container has been opened but also leaves broken bridges with sharp edges which may contact the fingers of a consumer. The sharp edges are more troublesome on metallic closures, such as those made of aluminum, than on thermoplastic closures. However, in either case, the sharp edges of the broken bridges do present a nuisance to the ultimate consumer when he or she initially removes the closure or when the closure is reapplied and subsequently removed.

Now a method has been invented for producing a pilferproof closure which overcomes this problem.

SUMMARY OF THE INVENTION

Briefly, this invention relates to a method of forming a pilferproof closure constructed of either a metallic or a thermoplastic material. For a metal closure, the method comprises stamping a disc and drawing the disc into a cup-shaped shell. The shell has an end wall and an annular sidewall depending therefrom which is trimmed to obtain a uniform height. An outwardly projecting annular ring is rolled into the sidewall such that the ring has a diameter greater than the outside diameter of the sidewall. The shell is then scored adjacent to the annular ring to form a circumferential scoreline consisting of alternately arranged slits and fracturable bridges. The scoreline divides the sidewall into an upper portion which is susceptible to being deformed about a threaded neck of a container and a lower portion which is adapted to be at least partially turned inwardly and into engagement with an annular shoulder formed on the container below the threaded neck. The shell is then compressed such that the annular ring is squeezed to form a outwardly and downwardly extending bead which covers the scoreline.

For a thermoplastic closure, the method is similar except that the closure is formed in a molding machine and the annular bead is integrally formed with the sidewall. The annular bead can be either formed during the molding process or it can be a separate member which is secured to the outside of the sidewall such that it overlaps the scoreline.

The general object of this invention is to provide a method of forming a pilferproof closure. A more specific object of this invention is to provide a method of forming a roll-on pilferproof closure having an annular shield which protects the fingers of the consumer from the sharp edges of the fractured bridges.

Another object of this invention is to provide a method of forming a pilferproof closure having an annular bead which visibly hides the scoreline formed on the closure.

Still another object of this invention is to provide a simple and economical method for forming a pilferproof closure having means for shielding the sharp edges of the fractured bridges from the person who removes the closure.

Still further, an object of this invention is to provide a method of forming a thermoplastic closure having an annular bead which covers the sharp edges of the fracturable bridges, thus preventing injury to the person who removes the closure from the container.

Other objects and advantages of the present invention will become more apparent to those skilled in the art in view of the following description and the accompanying drawings.

DETAILED DESCRIPTION OF THE PREFERRED EMBODIMENTS

Figure 1:
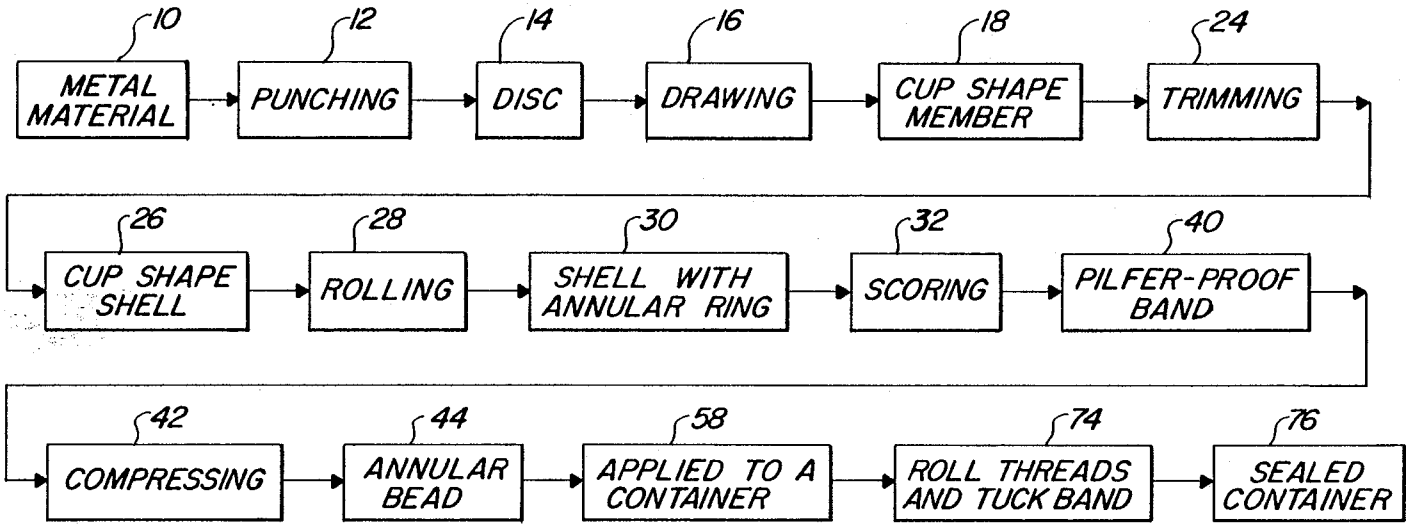
FIG. 1 is a schematic flow diagram showing a method of forming a pilferproof closure having an annular shield which protects the ultimate user from the sharp edges of the fracturable bridge.
Figure 2:
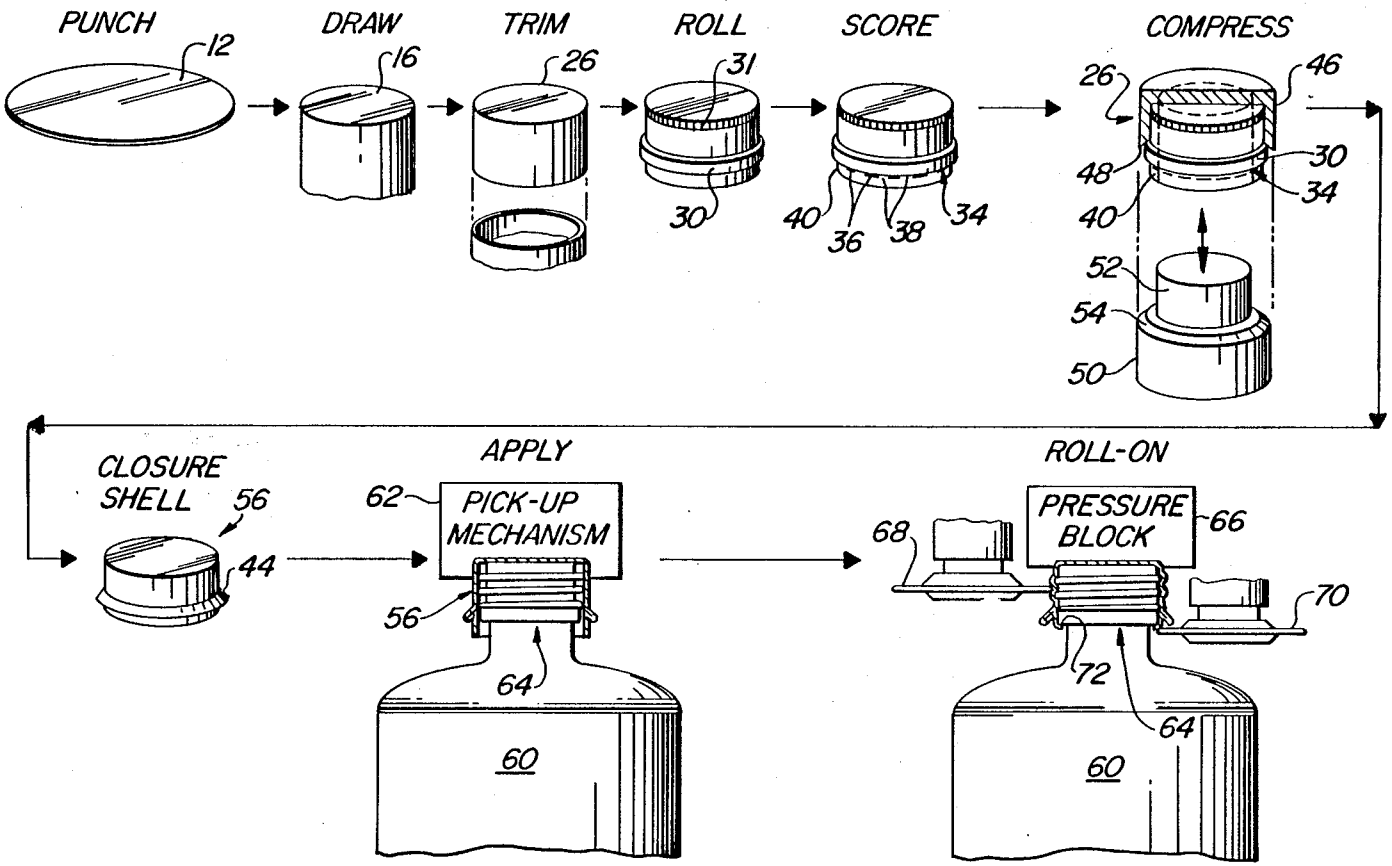
FIG. 2 is a schematic representation of the method of forming a closure showing the various steps which the closure is subjected to and showing its transformation up to the point where it is rolled onto a container.

Referring to FIGS. 1 and 2, a method of forming a pilferproof closure from a metallic material is shown. A metal material 10, such as aluminum or a hard aluminum alloy, having a very thin thickness and preferably in sheet form is subjected to a punch 12 which cuts or stamps the material 10 into a circular disc 14. The disc 14 is sized to produce a closure having a particular cross-sectional diameter. For instance, a four inch diameter disc may be required to produce a closure having a two inch diameter. The disc 14 is then subjected to a drawing operation 16 in order to produce a cup-shaped member 18. In the drawing operation 16, the disc 14 is pressed down and over a cylindrical form to produce an end wall 20 having a downwardly depending annular sidewall 22 (see FIG. 3). The open end of the cup-shaped member 18 is normally irregular after the drawing operation 16 and therefore is subjected to a trimming operation 24. The trimming operation 24 produces a cup-shaped shell 26 which has a uniform height. The uniform height is needed in order to produce a closure having a predetermined height after it is rolled and compressed so as to match the particular finish which is provided on a container. The word "finish" is used to describe the neck profile on a glass or plastic bottle.

The cup-shaped shell 26 is then subjected to a rolling operation 28 wherein an outwardly extending annular ring 30 is formed in the sidewall 22. The outside diameter of the annular ring 30, as well as the beveled edges which join it to the sidewall 22, can be sized and shaped according to one's wishes. Preferably the annular ring 30 is formed in a lower portion of the sidewall 22. The cup-shaped shell 26 can also be knurled or beaded circumferentially about an upper portion of the sidewall 22, as is indicated by numeral 31. Such knurls or beads 31 provide a rough surface so that the closure can be grasped and removed from a container. The knurls 31 also give the closure an aesthetically pleasing appearance. This operation can be carried out simultaneously with the rolling operation 28.

The cup-shaped shell 26 is then subjected to a scoring operation 32 to produce a scoreline 34. The scoreline 34 is preferably formed adjacent to and just below the annular ring 30 and consists of a plurality of alternately arranged slits 36 and bridges 38. The scoreline 34 separates or bifurcates a pilferproof band 40 from the upper portion of the sidewall 22. The bridges 38 connect the pilferproof band 40 to the sidewall 22 and are designed to fracture and break as the closure is unthreaded from the container. The fracturing of the bridges 38 tends to produce sharp or irregular edges which if contacted by the fingers of a person unthreading the closure could possibly scratch or cut them.

Figure 3:
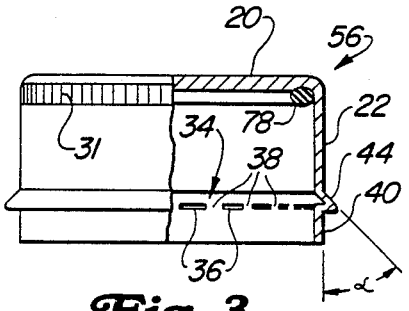
FIG. 3 is a partial cross-sectional view of a roll-on pilferproof closure formed with a collapsible bead.

The scored cup-shaped shell 26 is then subjected to a compressing step 42 wherein the annular ring 30 is compressed or squeezed so that it collapses and forms an annular bead 44. Referring to FIG. 3, the bead 44 can be compressed or squeezed to its desired shape by employing a cup-shaped die 46 which is normally stationary and which is designed to hold the cup-shaped shell 26. The die 46 has a beveled surface 48 which will contact at least a portion of the annular ring 30. A movable tool 50, having an outwardly projecting core 52 and a beveled surface 54, is moved into alignment with the die 46 and contacts the closure shell 26 so as to squeeze or collapse the annular ring 30. The core 52 prevents the annular ring 30 from buckling inward while the beveled surface 54 cooperates with the beveled surface 48 to give the desired outer profile to the annular bead 44. It should be noted that although the die 46 and the tool 50 contain beveled surfaces 48 and 54, respectively, these surfaces can be machined so as to produce a rounded or concave surface if that is desired. It should also be noted that the upward stroke of the tool 50 into the die 46 can be limited or restricted such that the overall height dimension of a semi-finished closure shell 56 will be within a predetermined tolerance.

The semi-finished closure shell 56 can now be applied 58 to a container 60. This can be done by a conventional pick-up mechanism 62 which individually picks up a closure shell 56 and places it in the correct orientation over the threaded neck portion 64 of the container 60. Once applied, the closure shell 56 is contacted with a pressure block 66 to hold it firmly against the container 60 while a thread roller 68 and a pilferproof roller 70 are brought into radial contact with the sidewall 22 and the pilfer band 40, respectively. The thread roller 68 and the pilferproof roller 70 can contact the sidewall 22 and the pilferproof band 40 simultaneously. The thread roller 68 will press against the sidewall 22 and deform it inward against the threaded neck of the container 60 while the pilferproof roller 70 will cause a lower portion of the pilferproof band 40 to tuck under an annular shoulder 72 formed on the container 60 below the threaded neck 64. This rolling operation 74 produces a sealed container 76.

Referring again to FIG. 3, the semi-finished closure shell 56 can contain a liner 78 preferably constructed of ethylene vinyl acetate copolymer, plastisol, pulp board or other suitable material in the shape of a ring or doughnut which will assist in forming a tight seal against the rim of the container 60 once the closure shell 56 is applied thereon. The annular bead 44 is compressed to at least partially hide the scoreline 34. The bead 44 can partially overlap a portion of the pilferproof band 40 but should not interfere with the fracturing of the bridges 38. The annular bead 44 can accomplish this by being compressed outwardly and downwardly so as to form an angle alpha ($\alpha$) which is less than 90°, preferably between about 30° and 80° and more preferably about 45°, relative to a longitudinal centerline passing through the closure shell 56. It should be noted that the diameter of the compressed annular bead 44 will be larger than at least a section of the outside diameter of the pilferproof band 40 or of the sidewall 22. This size difference will assure that the fingertips of a person who unthreads the closure will not come in contact with the sharp edges of the fractured bridges 38.

Figure 5:
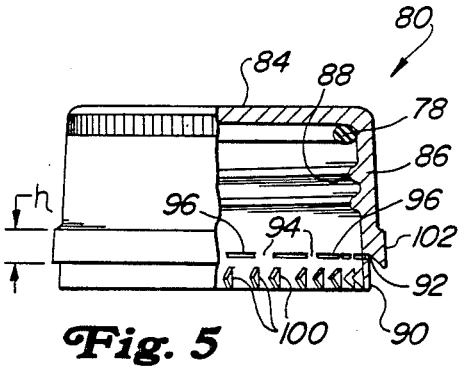
FIG. 5 is a partial cross-sectional view of a thermoplastic closure having an annular bead integrally formed thereon.
Figure 4:
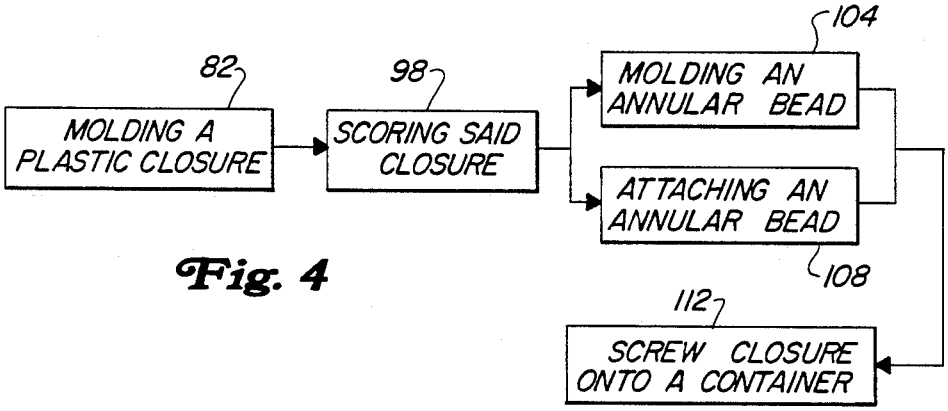
FIG. 4 is a schematic flow diagram showing a method of forming a thermoplastic closure having an annular bead for shielding the sharp edges of the broken bridges.

Referring now to FIGS. 4 and 5, a plastic pilferproof closure 80 can be formed by a molding process 82. In the molding process 82, a cup-shaped member is formed having an end wall 84 and an annularly depending sidewall 86. The annular sidewall 86 can be perpendicularly aligned to the end wall 84 or it can be angled thereto such that the closure 80 has an outwardly or inwardly tapered configuration. The closure 80 has an internal thread 88 formed therein which cooperates with the threaded neck of a container. The closure 80 also contains a pilferproof band 90 which is attached to a lower surface 92 of the sidewall 86. The attachment is by a plurality of fracturable bridges 94 which are separated by horizontal slits 96 which can be formed during the molding process 82. The bridges 94 and slits 96 can also be formed in a scoring operation 98 once the cup-shaped member has been formed and solidified. A typical scoring operation involves rotating one or more knives around the periphery of the closure 80 so as to form a scoreline separating the sidewall 86 from the pilferproof band 90. The bridges 94 can connect an inner surface of the sidewall 86 to an inner surface of the pilferproof band 90.

The pilferproof band 90 should contain engagement means 100 formed on its inner periphery which will be sized and shaped so as to engage an annular shoulder formed on the container below its threaded neck. As shown in FIG. 5, the engagement means 100 can consist of a plurality of flexible wings as is taught in U.S. Pat. No. 4,418,828. or be circumferentially spaced flaps as shown in U.S. Pat. No. 4,635,808. Both of these patents are incorporated by reference and made a part hereof. It should be noted that many other types of engagement means 100 can be formed on the inner surface of the pilferproof band 90.

The closure 80 also has an annular bead 102 which at least partially covers the bridges 94 and can also cover a portion of the annular band 90. The annular bead 102 can be integrally molded during the molding process 82 such that it will have a diameter greater than the outside diameter of at least a portion of the annular sidewall 86. When the annular bead 102 is molded, a slight taper can be designed into the sidewall 86 such that the annular bead 102 will have a height (h) which is sufficient to at least partially cover the bridges 94. By keeping the height (h) to a minimum, one can form a thin wall closure with a minimum amount of difficulty. The plastic closure 80 with the integrally formed annular bead 102 can be subjected to a scoring operation 98 wherein the slits 96 are formed at an angle relative to a horizontal plane passing through the closure.

Figure 6:
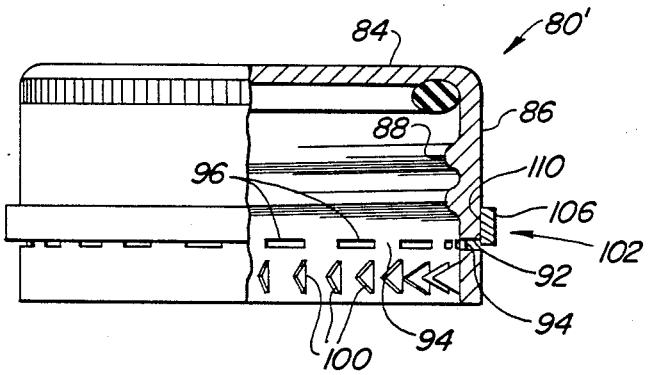
FIG. 6 is a partial cross-sectional view of a plastic closure having an independent annular member attached thereto.

Referring to FIG. 6, a separate or independent annular member 106 is shown which is secured to a closure 80' by an attaching process 108. In this arrangement, the annular member 106 has an inner surface 110 that is sized so as to form an interference fit with the sidewall 86 approximate the location of the bridges 94. It is also possible to taper the exterior surface of the sidewall 86 as well as the inner surface 110 of the annular member 106 such that when they are attached they will form an interference fit. The use of a separate member 106 requires an assembly operation but could be useful for closures where the annular bead 102 cannot be integrally molded in place. Furthermore, the member 106 can be formed to have an exterior shape which is aesthetically pleasing once it is assembled onto the closure 80. Once the closure 80 or 80' has been molded and/or assembled, it can then be applied in a screwing operation 112 to seal a container. As the closure 80 or 80' is unthreaded from the neck of the container, the bridges 94 will break and the closure 80 or 80' can be removed. In either case, the annular bead 102 or 106 will be separated from the pilferproof band 90 and should not interfere with the fracturing of the bridges 94.

While the invention has been described in conjunction with several specific embodiments, it is to be understood that many alternatives, modifications and variations will be apparent to those skilled in the art in light of the aforegoing description. Accordingly, this invention is intended to embrace all such alternatives, modifications and variations which fall within the spirit and scope of the appended claims.

I claim:

1. A method of forming a pilferproof closure comprising in sequence the steps of:

(a) forming a cup-shaped member having an end wall and an annular sidewall depending therefrom;

(b) forming an annular ring in said sidewall such that said ring has a greater diameter than the outside diameter of said sidewall;

(c) forming a circumferential scoreline consisting of alternately arranged slits and fracturable bridges in a right cylindrical portion of the sidewall below and adjacent to said annular ring, said scoreline bifurcating said sidewall into an upper portion which is susceptible to being deformed about a threaded neck of a container and a lower portion which is adapted to be at least partly turned inwardly and into engagement with an annular shoulder formed on said container below said threaded neck;

(d) supporting said sidewall in the zone of said scoreline against inward collapse; and (e) while supporting said sidewall, compressing said annular ring to form an outwardly and downwardly extending bead at least partially covering said bridges.

2. The method of claim 1 wherein compressing said annular ring reduces the height of said closure.

3. The method of claim 1 wherein said bead covers at least a section of said lower portion of said sidewall.

4. The method of claim 1 wherein said closure is constructed of aluminum.

5. A method of forming a pilferprof closure comprising in sequence the steps of:

(a) stamping a disc out of a sheet of metallic material and drawing said disc into a cup-shaped shell having an end wall and an annular sidewall depending therefrom;

(b) rolling an annular ring in said sidewall such that said ring has a diameter greater than the outside diameter of said sidewall;

(c) forming a circumferential scoreline consisting of alternately arranged slits and fracturable bridges in a right cylindrical portion of said sidewall below and adjacent to said annular ring, said scoreline bifurcating said sidewall into an upper portion which is susceptible to being deformed about a threaded neck of a container and a lower portion which is adapted to be at least partly turned inwardly and into engagement with an annular shoulder formed on said container below said threaded neck;

(d) supporting said sidewall in the zone of said scoreline against inward collapse; and (e) while supporting said sidewall, compressing said annular ring to form a bead with extends from said upper portion of said sidewall and downwardly over said scoreline.

6. The method of claim 5 wherein said bead is extended at an angle of between about 30° and 80° relative to said lower portion of said sidewall.

7. The method of claim 5 wherein said cup-shaped shell has a uniform height.

8. A method of forming a roll-on, pilferproof closure for fitment to a container having a threaded neck and an annular shoulder formed below said threaded neck, said method comprising in sequence the steps of:

(a) stamping a disc out of a sheet of aluminum;

(b) drawing said disc into a cup-shaped member having an end wall and an annular sidewall depending therefrom;

(c) forming an annular ring in said sidewall such that said ring has a diameter greater than at least a section of said sidewall;

(d) forming a cylindrical scoreline consisting of alternately arranged slits and bridges in a right cylindrical portion of said sidewall below and adjacent to said annular ring, said scoreline bifurcating said sidewall into an upper portion which is susceptible to being deformed about said threaded neck and a lower portion which is adapted to be at least partly turned inwardly and into engagement with said annular shoulder;

(e) supporting said sidewall in the zone of said scoreline against inward collapse; and (f) while supporting said sidewall, compressing said annular ring to form a bead which extends outwardly and downwardly from said upper portion of said sidewall and shields edges of fracturable bridges upon removal of said closure from said container.

9. The method of claim 8 wherein said lower portion of said sidewall is compressed against said upper portion of said sidewall to form a closure having a uniform height.

10. The method of claim 8 wherein in forming said annular ring said upper portion of said sidewall is held secure and said lower portion of said sidewall is compressed against said upper portion thereby causing said annular ring to buckle outwardly.

11. The method of claim 10 wherein in forming said annular ring a core tool is inserted into said cup-shaped member which prevents said annular ring from collapsing inwardly during compression of said closure.

12. A method of forming a roll-on, pilferproof closure for fitment to a container having a threaded neck and an annular shoulder formed below said threaded neck, said method comprising in sequence the steps of:

(a) stamping a disc out of a sheet of metallic material and drawing said disc into a cup-shaped shell having an end wall and an annular sidewall depending therefrom, said shell having a uniform height;

(b) rolling an annular ring in said sidewall such that said annular ring has a diameter greater than at least a section of said sidewall;

(c) forming a circumferential scoreline consisting of alternately arranged slits and fracturable bridges in a right cylindrical portion of said sidewall below and adjacent to said annular ring, said scoreline bifurcating said sidewall into an upper portion and a lower portion;

(d) supporting said sidewall in the zone of said scoreline against inward collapse;

(e) while supporting said sidewall, compressing said annular ring to form a bead which extends outwardly and downwardly from said upper portion of said sidewall and over said scoreline;

(f) placing said cup-shaped shell onto said container; and (g) rolling said upper portion of said sidewall against said threaded neck and rolling at least part of said lower portion of said sidewall inwardly and into engagement with said annular shoulder such that said lower portion will remain on said container after said closure is unthreaded.

13. The method of claim 12 wherein said metallic material is aluminum.

14. The method of claim 12 wherein said upper and lower portions of said sidewall are rolled simultaneously.

* * * * *